US006292977B1

(12) United States Patent
Mantyla et al.

(10) Patent No.: US 6,292,977 B1
(45) Date of Patent: Sep. 25, 2001

(54) VACUUM FITTING

(75) Inventors: James Mantyla, Barrie; Nicholas Broeders, Stroud, both of (CA)

(73) Assignee: Canplas Industries Ltd., Barrie (CA)

( * ) Notice: Subject to any disclaimer, the term of this patent is extended or adjusted under 35 U.S.C. 154(b) by 0 days.

(21) Appl. No.: 09/391,652

(22) Filed: Sep. 7, 1999

(51) Int. Cl.[7] ..... A47L 5/38
(52) U.S. Cl. ..... 15/310; 15/301
(58) Field of Search ..... 15/301, 310, 314, 15/339

(56) References Cited

U.S. PATENT DOCUMENTS

| | | | | |
|---|---|---|---|---|
| 2,810,028 | * | 10/1957 | Hopper | 15/301 |
| 3,027,587 | | 4/1962 | Bierstock . | |
| 3,027,588 | | 4/1962 | Bierstock . | |
| 3,655,927 | | 4/1972 | Samuelson et al. . | |
| 3,676,986 | | 7/1972 | Reiling . | |
| 5,083,704 | | 1/1992 | Rounthwaite . | |
| 5,205,013 | | 4/1993 | Lopes . | |
| 5,279,016 | | 1/1994 | Klassen . | |
| 5,408,721 | | 4/1995 | Wall et al. . | |
| 5,504,967 | | 4/1996 | Graham . | |
| 6,108,858 | * | 8/2000 | Smith | 15/314 |

FOREIGN PATENT DOCUMENTS

| | | |
|---|---|---|
| 642539 | 6/1962 | (CA) . |
| 670879 | 9/1963 | (CA) . |
| 675552 | 12/1963 | (CA) . |
| 2101484 | 1/1994 | (CA) . |
| 2105554 | 3/1995 | (CA) . |
| 2125595 | 6/1995 | (CA) . |

* cited by examiner

*Primary Examiner*—Terrence R. Till
(74) *Attorney, Agent, or Firm*—Piasetzki & Nenniger

(57) ABSTRACT

A vacuum fitting for connection to a remote source of vacuum, the vacuum fitting comprising a main body mountable to a fixed structure. The main body includes an inlet opening and an outlet opening; an openable closure mounted to the main body and being moveable between an open position and position covering the inlet opening; a latch member selectively positionable to keep the closure in said covering position when positioned between the main body and the closure and to permit said closure to move to an open position when not positioned between said main body and the closure; and a biaser to urge the closure to an open position. A switch is also provided to initiate the remote source of vacuum when the closure is moved to the open position by the biaser.

12 Claims, 5 Drawing Sheets

VACUUM FITTING

FIELD OF THE INVENTION

This invention relates generally to the field of vacuum fittings of the type that are connected to a source of vacuum. One type of vacuum source is a central vacuum system used to clean building enclosures, such as houses. In particular, this invention relates to a vacuum fitting of the type that may be permanently mounted adjacent to a floor so that dust, dirt and debris may be swept along the floor and passed into the vacuum system through the fitting by means of the suction or vacuum.

BACKGROUND OF THE INVENTION

Attempts have been made in the past to develop a vacuum fitting which is permanently mounted into a wall or floor adjacent to a surface to be swept. Such fittings may be for use in association with either a central vacuum system or a portable vacuum cleaner system. The vacuum fitting ideally opens to permit air suction to flow through the fitting to pick up and carry dirt, debris and the like through the fitting and into a remote collection chamber associated with the vacuum source. Early attempts at such fittings involved cumbersome moving assemblies having nozzles which advanced out into a room to direct the suction to a place where the sweepings were collected. The sweepings would then would then be sucked up through the nozzle and taken away. However, these devices were awkward, expensive, and generally impractical. Examples of these may be found in Canadian patents 642,539, 670,879 and 675,552 to Bierstock.

More lately, there have been a number of devices developed which are somewhat simpler and which provide a fixed vacuum inlet fitting adjacent to a floor to be swept. For example, Klassen Canadian Patent 2,101,484, teaches a device which can be mounted in a floor or a wall and which is connected to the remote source of vacuum so that when a seal in the device is opened, by a foot activated lever, the remote source of vacuum is energized. This causes suction through the opening and removes undesirable sweepings from the surface being swept. Unfortunately, the Klassen device impractically requires that a person maintain their foot on the lever in order to maintain the electrical connection to energize the source of vacuum and also to keep the seal open. This is awkward and impractical as it means that the sweeping must be finished while standing on one foot.

Even more recently, a device to an inventor named Graham has been disclosed in Canadian Patent 2,123,179 which includes a closure member mounted within a housing. A lever extends out through an open front inlet and pivots the closure between two positions which open and close an outlet opening located in a top wall of the housing. A double acting spring is associated with the closure member and acts to hold the closure member in both open and closed positions. In this manner, the unit can be activated by a foot of the user. Sweepings can then be swept up to the mouth of the unit and taken away by the suction. When finished, the operator may again use their foot to move the lever to cause the closure to cover the outlet opening and to disengage the electrical contact. This switches off the remote source of vacuum.

While simple in approach, this device suffers the disability that the foot operated lever or switch extends from the front face of the fitting. Thus the front face must be always open to accommodate the lever. While this may be partially acceptable when the unit is partially hidden, for example, by being installed under a toe rail of a kitchen counter, this opening is not acceptable in, for example a front hall, mud room or other plain view application. The open front means the inside of the device, which often becomes dirty and unattractive over time is in plain view. This require s more maintenance in terms of cleaning and the like.

Further, in use, typically a user will sweep back and forth across the inlet opening to ensure that all of the crumbs or debris are swept up. Such sweeping action often accidentally switches the unit off, because the foot operated lever projects out, unprotected, from the housing. Rapid on/off energization of the central vacuum motor causes undue wear and can lead to premature failure of the motor. Finally, the top outlet opening makes installation awkward, since often the source of vacuum is from below. A top opening requires multiple elbow fittings and short tubing sections to plumb in the connection to a below grade vacuum source.

SUMMARY OF THE INVENTION

What is desired is a simple to use device which overcomes the limitations of the prior art. Preferably the device should be simple to make and involve a minimum of parts and expense. Further the device should be robust, and not prone to accidental rapid on/off switching during sweeping. As well the device should not provide an open front which both unsightly and a source of dirt collection which requires more maintenance. Also the device should be easy to install either under a cabinet or in a wall. Most preferably the device should be equally easy to plumb to a source of vacuum no matter whether the vacuum tubing leads up, down or sideways from the fitting.

Therefore according to one aspect of the present invention there is provided a vacuum fitting for connection to a source of vacuum, said vacuum fitting comprising:

- a main body mountable to a fixed structure, said main body including an inlet opening and an outlet opening;
- an openable closure mounted to said main body and being moveable between an open position and a closed position;
- a latch member selectively positionable between said main body and said closure to keep said closure in a closed position when positioned between said main body and said closure and to permit said closure to move to an open position when not positioned between said main body and said closure;
- a biaser to urge said closure to an open position; and
- a switch to initiate said remote source of vacuum when said closure assumes said open position.

BRIEF DESCRIPTION OF THE DRAWINGS

Reference will now be made to drawings of preferred embodiments of the invention, by way of example only, and in which.

DETAILED DESCRIPTION OF THE PREFERRED EMBODIMENTS

Figure 1:
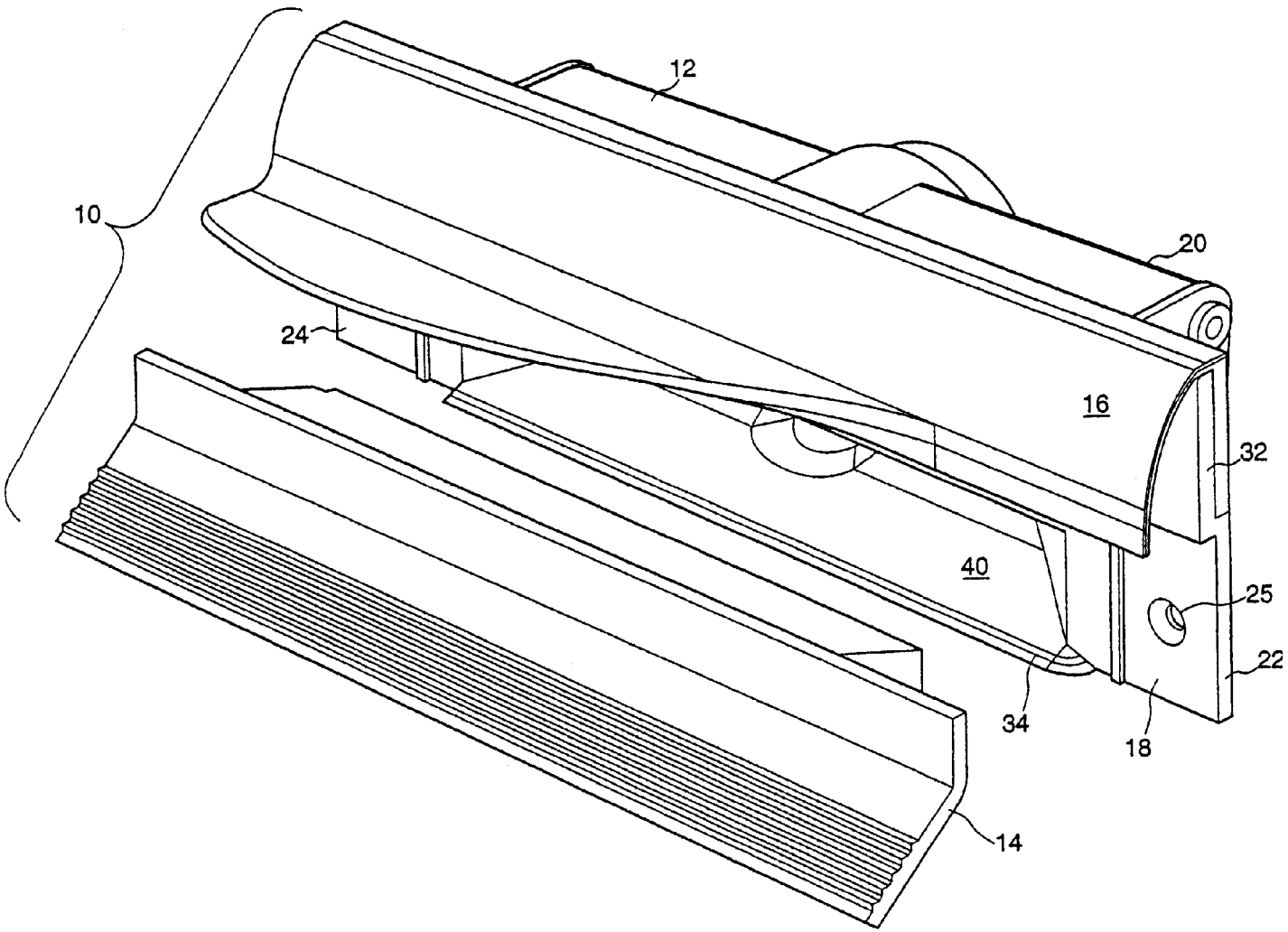
FIG. 1 is a front perspective view showing the three main elements of the preferred embodiment of the invention, namely a main body, a door member in exploded position for illustration purposes and a latch member.

FIG. 1 shows a vacuum fitting for connection to a source of vacuum generally at 10. The vacuum fitting 10 is comprised of three main elements, namely, a main body 12, a door member 14 and a latch member 16. The door member 14 is shown in exploded position in FIG. 1 but is normally located under the latch member on the front of the main body 12. Each of these elements is described in greater detail below.

The main body 12 includes a room facing side 18 and a rear or backside 20. Beginning with the room facing side 18 there are provided side mounting flanges 22, 24 on either lateral side of the main body 12. In each flange 22, 24 there is preferably provided a mounting aperture such as 25, 26 to receive a fastener, such as a screw (not shown). Most preferably the mounting aperture is chamfered to permit the fastener 30 to be countersunk into the flange 22, 24. In this manner the flange surface is preferable smooth and the fastener head projects very little if at all beyond the outer face of the flange.

Figure 2:
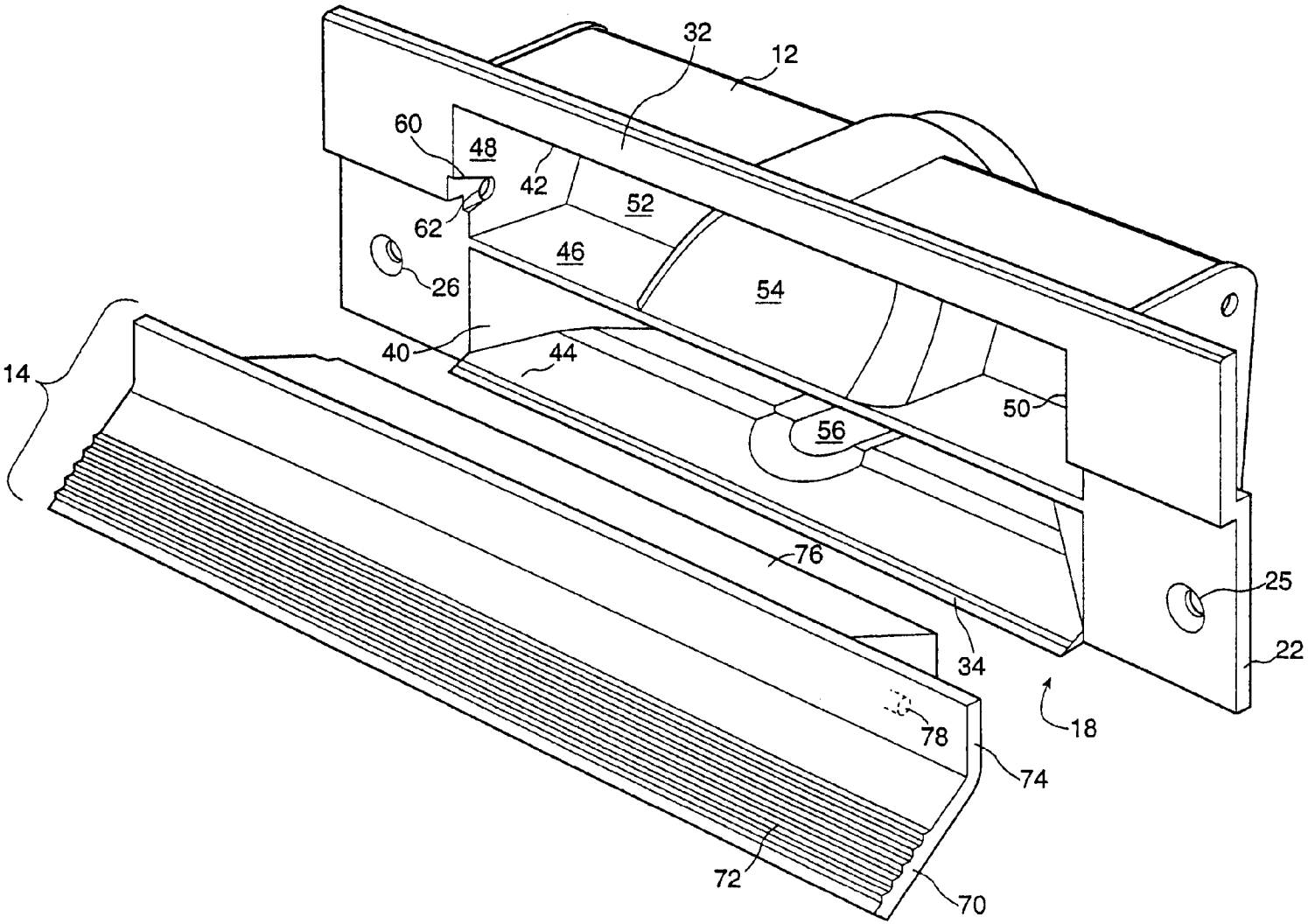
FIG. 2 is an equivalent view showing the main body and the door member of FIG. 1 without the latch member.

It will also be noted that the flanges 22, 24 are joined across the top of the main body by a top flange 32 which is shown more clearly in FIG. 2. Extending across the bottom edge of the room facing side is a sweepings ramp 34. The flanges 22, 24, 32 and the ramp 34 are configured so that when an appropriately sized opening is cut into a baseboard of a wall, or a kitchen cabinet, the flanges will cover the rough cut edges of the wall or cabinet opening and the sweepings ramp will lie against the floor being swept.

FIG. 2 also shows the room facing side 18 having a door receiving opening 40. The door receiving opening 40 is divided approximately into two halves, an upper half 42 and a lower half 44, by a partition 46. The partition 46 extends between side walls 48, 50, a back wall 52 and a front edge of the door receiving opening 40. Rising out of the partition 46 is an arch 54 of a rearwardly extending shaped passageway 56 as described in more detail below. The partition 46 and the arch 54 of the shaped passageway form a continuous top wall. The shaped passageway 56 below partition 46 forms a suction chamber through which sweepings may be drawn by suction and then exit the chamber through an opening at the back.

Shown at one side is a hinge slot 60, ending in a hinge hole 62 which is located above the partition 46. The hinge slot 60 is to facilitate the installation of the door member 14 as described in more detail below.

Turning now to the door member 14 it is shown in exploded position relative to the main body 12, but it will be appreciated by those skilled in the art that in use the door member 14 is mounted out in front of the main body 12. The door member 14 is comprised of an actuating or toe press section 70 having gripping means 72 and an angled top section 74. In addition to the door member 14, there is a hinge section 76 which extends rearwardly from the top section 74 and the toe press section 72. On each lateral side of the hinge section 76 are located small circular axles 78 which are sized and shaped to be inserted into the hinge hole 62 described above. It will now be appreciated that the hinge section 76 is sized and shaped to be inserted above the partition 46.

The door 14 is preferably molded with the hinge section 76 from a suitable plastic material and assembled to the main body after molding in a separate manufacturing step. To insert the hinge section 76 into the main body, all that is required is to line up the axles 78 with the hinge slots 60 and then force the hinge section 76 into the front of the main body 122 until the axles 78 rest in the hinge holes 62. In this manner the hinge holes 62 form, in combination with the axles 78 a pivoting attachment of the door member 14 to the main body 12 with the door member 14 out front of the main body 12. When so installed, the door member 14 may be pivoted about a horizontal pivot axis to cover and uncover the door opening 40.

Figure 3:
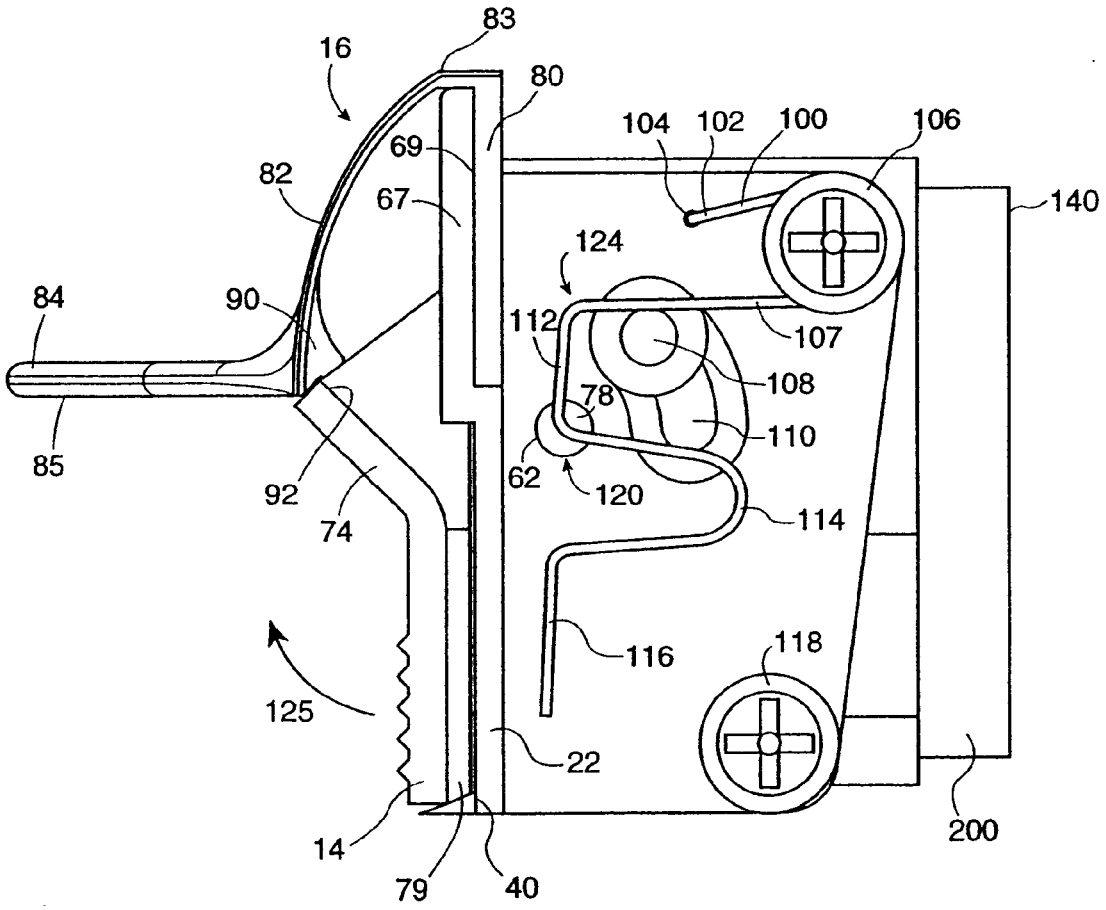
FIG. 3 is a side view of the preferred invention with the door member covering a door opening in said main body.

As shown in FIG. 3, a seal 79 is also provided to seal the door opening 40 of the suction passageway 56 against suction when the unit 10 is not in use. It will be appreciated that the present unit 10 will be plumbed through the rear facing exit into a central vacuum system (not shown) which will likely have many outlets located throughout a building space. Use of one outlet typically means that a remote source of vacuum is activated, creating suction throughout the system. All of the outlet valves not then in use must be sealed to prevent an unwanted loss of vacuum throughout the system. Hence the desire to provide a seal in the other fittings when not in use.

When the present invention is not in use, but an adjoining outlet is, the vacuum in the system will create a negative pressure behind the door member 14. This negative pressure will act to either draw the door member 14 closed, if it was open slightly, or most preferably to keep the door closed. The seal 79 is sized and shaped to extend around the preiphery of the door opening and will bear flat against the side flanges 22, 24 and along the partition 46. Preferably the seal will project beyond a back face of the door member 14 slightly at a lower edge thereof, so as to engage the surface of the sweepings ramp 34, which as previously described, forms the lower edge of the door or inlet opening 40. The projection of the seal 79 may be either in the downward direction or rearward, provided the seal 79 is sized and shaped to seal against the ramp 34. In this way, when the door 14 is fully closed, a seal can be formed all around the periphery of the lower half 44 of the door opening 40, thus preserving suction in the suction chamber and in the remote vacuum system.

The preferred form of seal 79 is a single piece of foam rubber which is glued or otherwise affixed to the back of the actuating portion of the door member 14. The seal 79 can be either fixed in the middle and left free along the edges to permit it to flop outwardly to closed the gap with the door opening 40, or glued along the edges and of sufficient thickness and resiliency to ensure a good fit against the door member 14.

It will further be appreciated that the seal 79 can be of any shape provided the same covers any gap between the door member 14 and the door opening 40. For example, while the preferred seal 79 is a rectangular shape, the seal 79 could also be made with a rectangular cut out, leaving only the perimeter. Further the seal 79 could be mounted to the door 14 or to the main body 12, depending upon preferences. It is believed that mounting the seal 79 on the door member 14 is preferred, because that way the seal is moved out of the way as the door opens. In this way the sweepings do not come into contact with the seal 79 and thus are less likely to foul the same which could result in a loss of vacuum. Also, it is less preferable to place the seal 79 on the ramp 34 itself, as that would make it more difficult to take the sweepings up into the main body 12. All that is required is to have a complete seal around the perimeter when the fitting is not in use but the system is in use.

The third element of the device 10 as shown in FIGS. 1 and 3 is a latch element 16. It will be noted that the side flanges 22, 24 of the main body 12 have forward offsets 67 for approximately the upper half of the flange. This provides a securing face 69 behind the flange 32 to secure the latch element 16. It is preferred for the device 10 to be able to lie flat against a vertical surface such as a toe rail of a kitchen cabinet. Thus it is preferred to include the forward offsets 67 to provide a smooth back surface on the fitting.

The latch element 16 includes an attachment flange 80, which is preferably integrally molded to a overhanging member 82, along a continuous edge 83. In the preferred embodiment the latch element 16 is bonded to the securing face by means of an adhesive, solvent welding or the like. It will be appreciated by those skilled in the art that the latch element 16 could be attached to the main body 12 in a number of ways including separate mechanical fasteners or heat bonding without departing from the spirit of the present invention.

As shown in FIG. 2 the overhanging member 82 includes a portion 84, which is gently rounded in plan and extends outwardly (when viewed from above) for approximately one half of the side to side width of the device 10. The outward extension provides a toe lift latch 85. It will be appreciated by those skilled in the art that many different shapes could be used for the overhanging portion 84 of the latch element 16, but the disclosed shape provides easy access and use of both the latch element 16 and the door member 14 as described in more detail below. What is desired is to configure the latch element 16 to allow it to be easily manipulated by the foot or toe of a user. What is also desired is to also keep the door member 14 accessible to the toe of a user. In the preferred design this is accomplished by extending the toe lift portion 85 across approximately one half of the device10 to expose the door member 14 underneath to easy toe contact on the other half.

FIG. 3 shows the door member 14 in the position the door assumes when the device 10 is not in use, namely the door member 14 is covering the door opening 40. From FIG. 3 the inter-action between the door member 14 and the latch member 16 can be appreciated. Extending downwardly and inwardly from the latch 16 is a stop 90 to catch a top of the door at 92. The stop 90 may be continuous across the latch member 16 or it may be intermittent. What is required is to provide enough of a projection that the stop 90 extends behind the top angled portion 74 of the door 14 to prevent the door 14 from rotating about the horizontal hinge axis to an open position. It can be appreciated that the latch member 16 is resiliently deformable along edge 83. Thus when a person inserts their toe under the toe latch portion 84 and lifts, the latch member 16 is temporarily raised, causing the stop 90 to come free of the door member 14 freeing the door 14 to rotate to an open position. In this manner the latch member 16 is selectively positionable between the door element and the main body lo keep the door in a closed position or to permit the door to move to an open position.

Turning again to the position of the elements as shown in FIG. 3, the seal 79 preferably lies adjacent to the flange 22, 24 but is not pressed there against when the door member 14 cover the opening. Rather it is prefered if the suction in the main body 12, which arises when another outlet of the same vacuum system is in use, causes the door 14 to seal shut. In this sense it is preferred if the latch member 16 holds the door 14 in a covering, but not closed position. This has the added benefit of not keeping the compressible seal under constant compression which could over time lead to a loss of resiliency in the seal, by reason of permanent deformation. Rather it is preferred if the seal 79 is under compression only during the operation of the vacuum system, where the sealing force is provided by the suction in the system. This will enable the seal 79 to last longer and because it will not be permanently compressed will have less of a tendency to develop leaks around the edges over time.

Another element of the present invention is the biaser, or spring 100. The biaser 100 is most preferably in the form of a wire spring as shown, which has one end 102 secured in a hole 104 on the side of the main body 12. The spring then extends around a first electrical contact post 106 and then doubles back towards a front of the fitting at 107. This limb 107 of the spring 106 contacts a pin 108 which extends through a slot 110 through the side of the main body. The pin 108 is secured to the door member 14. The spring continues with a downwardly extending limb 112 with a hairpin section 114 and ends in a contact portion 116. A second electrical contact 118 is formed on the main body and the spring is preferably made from an electrically conducting material such as metal wire. It can now be appreciated that if the first electrical contact and the second electrical contact are wired to a circuit, the circuit may be closed if the spring 100 extends between the two.

Also shown in FIG. 3 is the door hinge 120. The door hinge is comprised of the axle extensions 78 of the door member 14 which are sized and shaped to fit closely within a circular hinge opening 62 in the main body as previously described. As can be seen from FIG. 3, the axle extension of the door member 14 is below the spring 100 and does not impede its movement in any way.

It can now be appreciated how the door member 14, the latch member 16, the main body 12 and the biaser 100 interact. In the position as shown in FIG. 3, the spring 100 is resiliently bent around the first electrical contact post 106 and is trying to return to an unbent position which results in a force in the direction of arrow 124. The spring 100 acts on the pin 108 urging the pin along (down) the slot 110. The door covering portion of door member 114 is on the opposite side of the door hinge 120 and thus the door covering portion is urged in the opposite direction, namely up, as shown by arrow 125 by spring force. In other words, the door is being urged by the spring to an opened position. The door is prevented from moving by the stop 90 of the latch member 16 which catches the top 92 of the angled portion 74 of the door 14. In this position the latch member 16 is operatively positioned between the main body 12 and the door member 14 to prevert the door from assuming a fully opened position.

Thus, when the toe latch is lifted by a toe of a user, the stop 90 disengages from the door 14 and the spring 100 opens the door 14. At the same time, the pin 108 moves along the slot 110 and the spring 100 then moves to a position where the end contact portion 116 of the spring can contact the second electrical contact post 118. This completes a low voltage circuit as described and initiates a remote source of vacuum. Because the spring 100 is urging the door member 14 to the open position, the unit will stay in operation until the user is finished, without needing any further contact from the user. It will be appreciated that hair pin section 114 allows the end contact portion 116 of the spring early contact with the electrical contact post, without exerting a reaction force that causes the pin 108 to stop in the slot 110 leaving the door only partly open. The hair pin section 114 permits early electrical contact while permitting a full range of travel along the slot 110.

When sweeping is finished, the user merely presses with their foot or toe on the exposed part of the door member 14, on the actuator portion 70. This will overcome the spring force and cause the door member 14 to rotate about the hinge and to lower to cover the opening 40. To assist in ease of use the door actuator portion is preferably provided with friction enhancing features such as gripping means 72. These may be in the form of ridges as shown, stippling or other roughening of the surface to allow the toe of the user to easily grip the door surface to press the same down.

Also shown in FIG. 3 is the rear opening 140 of the main body 12 which is the exit from suction chamber 56. It will be noted that the opening is defined by an attachment rim 200, which is sized and shaped to allow conventional fittings to be attached thereto. The exit or outlet from the main body is directed rearwardly. Thus, the exit can be easily joined to a short elbow fitting and plumbed to connect to vacuum piping whether coming from below or behind with equal ease.

In the most preferred form of the present invention the front to back dimension of the unit is small enough to fit within a standard wall. Thus, to allow room for an elbow, it is preferred if the fitting not exceed four inches in depth and most preferably not more that about three inches.

It can now be appreciated that to achieve such a compact configuration requires certain internal features of the main body 12. At the front the inlet opening 40, it is preferred to have a relatively long compared to its height opening to draw the suction through. At the rear it is preferred to have a circular exit to facilitate the connection of the fitting to vacuum piping. Thus the transition must be made from the front opening to the rear opening over a compact body with a continuous top wall, side walls and bottom wall to form the suction chamber.

Figure 4:
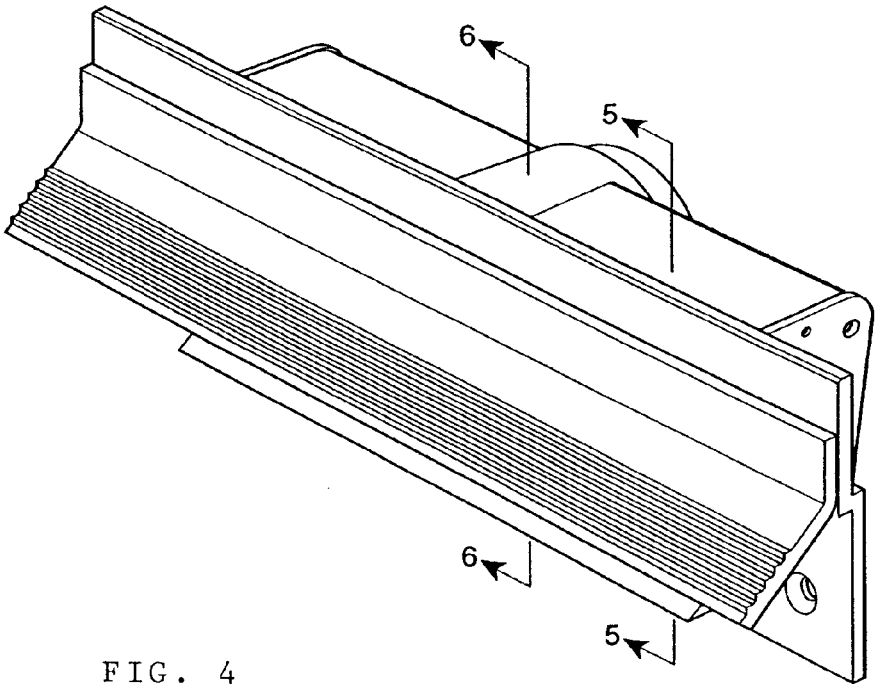
FIG. 4 is a front view of the invention showing the door member in an open position with the latch member removed for ease of illustration.
Figure 5:
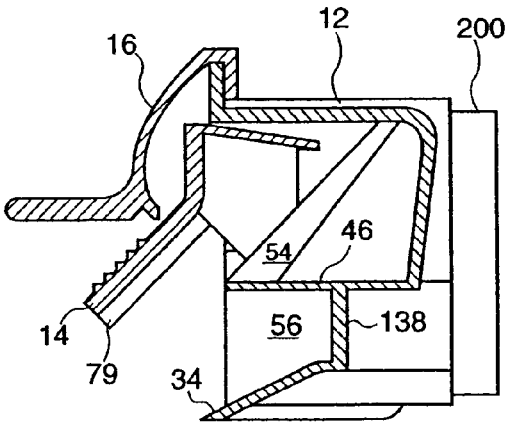
FIG. 5 is a cross-sectional view of the invention of FIG. 4 taken along line 5—5 with the latch member added.

This is accomplished by providing an internal wall or partition 46 in the main body 12 to define a lower suction chamber and an upper housing area as previously described. The internal configuration of the suction area can be more fully understood with reference to FIGS. 5 and 6. As can be seen in FIG. 5 which is a section along lines 5—5 in FIG. 4, the vacuum chamber 56 extends upwardly and rearwardly from front opening 40. In FIG. 5 it can be seen that apart from the rear outlet 140 the vacuum chamber has a solid back wall 138 at the sides. Most preferably this back wall is also angled (see FIG. 7) from back to front to encourage the flow of debris carried by suction to the rear exit 140.

Figure 6:
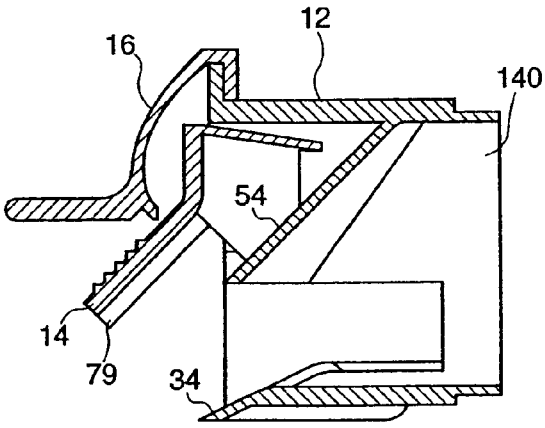
FIG. 6 is a cross-sectional view of the invention of FIG. 4 taken along lines 6—6 with the latch member added.
Figure 7:
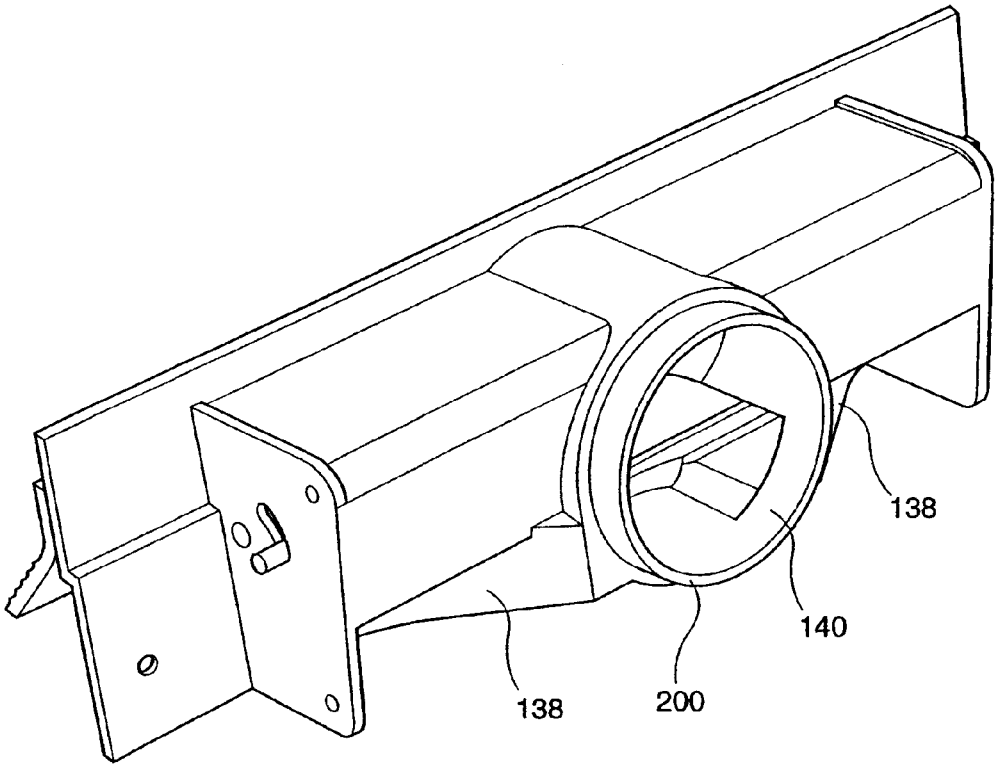
FIG. 7 is a rear perspective view of the invention of FIG. 4 showing the door member in an open position.

FIG. 6 shows a section through the outlet 140, showing the vacuum chamber rising from the ramp under the partition 46 and out the outlet 140.

It will also be noted that in the open position as shown in FIGS. 5 and 6 the angled portion lies against the opening of the main body above the partition in such a way that the opening is substantially closed. In this manner short circuiting of the suction, around the partition and then around the top edge of the door is prevented, causing more of the suction to pass through the open front and improving the effectiveness of the device.

It can now be appreciated by those skilled in the art that the present invention provides an easy to make and install fitting which overcomes the disadvantages of the prior art. In particular when not in use the device presents a covered front face which hides the internal workings of the device so that there is no need to have to clean or maintain the same Further the configuration of the latch, holding the door member in a door covering position, while the spring 100 urges the door open, provides for a long lasting seal which is only compressed by the suction in the system.

It will be appreciated by those skilled in the art that while reference has been made in the foregoing description to preferred embodiments of the present invention various modifications and alterations can be made without departing from the spirit of the invention as defined in the following claims. Some of these modifications have been discussed above and others will be apparent to those skilled in the art. For example, there are many forms of toe latch that would provide adequate results, provided that enough of an overhang is present to easily allow the stop to be disengaged from the door member on the one hand and yet not to cover the door so as to prevent a user from being able to easily close the door against the spring when required. Further, while preferred dimensions are provided for a compact device, minor variations will not have too great an input on how the device functions.

We claim:

1. A vacuum fitting for connection to a source of vacuum, said vacuum fitting comprising:

a main body mountable to a fixed structure adjacent to a surface to be swept, said main body including a sweepings inlet opening and an outlet opening;

an openable closure mounted to said main body and being moveable between an open position and position covering said sweepings inlet opening;

a latch member selectively positionable to keep said closure in said covering position when positioned between said main body and said closure and to permit said closure to move to an open position when not positioned between said main body and said closure said latch member including an outwardly extending toe lift portion;

a biaser to urge said closure to an open position; and a switch to initiate said remote source of vacuum when said closure assumes said open position.

2. A vacuum fitting as claimed in claim 1 wherein said openable closure pivots about a horizontal axis, and said latch member extends between a top of said main body and a top of said openable closure in said covering position.

3. A vacuum fitting as claimed in claim 1 wherein said openable closure includes an edge against which said latch catches.

4. A vacuum fitting as claimed in claim 1 wherein said latch member is formed from a resilient material which is displaceable out of the path of said openable closure to permit said openable closure to pass thereby.

5. A vacuum fitting as claimed in claim 1 wherein said latch member includes a stop element for abutting said openable closure.

6. A vacuum fitting as claimed in claim 1 wherein said openable closure includes a foot contacting surface which includes an anti slip feature.

7. A vacuum fitting as claimed in claim 6 wherein said anti slip feature comprises a roughened surface.

8. A vacuum fitting as claimed in claim 7 wherein said roughened surface comprises a plurality of ridges.

9. A vacuum fitting as claimed in claim 1 wherein said latch member is sufficiently resilient to allow a user to place a toe under said toe tab and to lift said toe tab enough to disengage said stop from said openable closure, and when released, it returns to a position in the path of said openable closure.

10. A vacuum fitting as claimed in claim 1 wherein said spring includes a hairpin for permitting early contact with an electrical connection without creating a reaction force.

11. A vacuum fitting as claimed in claim 1 wherein said main body has a rearwardly facing exit orifice and a front to back distance of less than four inches.

12. A vacuum fitting as claimed in claim 11 wherein said front to back width of said main body is less than about three inches.

* * * * *